US009066570B2

(12) United States Patent
Wright et al.

(10) Patent No.: US 9,066,570 B2
(45) Date of Patent: Jun. 30, 2015

(54) COSMETICS RETRIEVAL AND APPLICATOR TOOL WITH NON-POROUS TIP APPARATUS

(71) Applicant: Swoon Beauty, LLC., Brooklyn, NY (US)

(72) Inventors: Keisha L. Wright, Brooklyn, NY (US); H. Anthony Franklin, Sugarland, TX (US)

(73) Assignee: Swoon Beauty, LLC, Brooklyn, NY (US)

( * ) Notice: Subject to any disclaimer, the term of this patent is extended or adjusted under 35 U.S.C. 154(b) by 0 days.

(21) Appl. No.: 14/050,429

(22) Filed: Oct. 10, 2013

(65) Prior Publication Data

US 2014/0105665 A1 Apr. 17, 2014

Related U.S. Application Data

(60) Provisional application No. 61/712,799, filed on Oct. 11, 2012.

(51) Int. Cl.
*A45D 34/04* (2006.01)
*A45D 40/26* (2006.01)

(52) U.S. Cl.
CPC ..... *A45D 34/04* (2013.01); *A45D 40/26* (2013.01); *A45D 40/267* (2013.01); *A45D 40/265* (2013.01)

(58) Field of Classification Search
CPC ..... A45D 40/267; A45D 40/26; A45D 34/04
USPC ..... 132/317, 318, 320; 401/128
See application file for complete search history.

(56) References Cited

U.S. PATENT DOCUMENTS

| | | | | |
|---|---|---|---|---|
| 7,866,327 | B1 * | 1/2011 | Gueret | 132/218 |
| 2007/0017544 | A1 * | 1/2007 | Gueret | 132/320 |
| 2011/0114112 | A1 * | 5/2011 | Tsai | 132/218 |
| 2012/0057922 | A1 | 3/2012 | Manns | |
| 2012/0199158 | A1 * | 8/2012 | Bickford | 132/218 |

* cited by examiner

*Primary Examiner* — Rachel Steitz
(74) *Attorney, Agent, or Firm* — Boulware & Valoir

(57) ABSTRACT

The present application discloses a cosmetic device for accessing residual liquid and gel like cosmetics in hard to reach containers and applying the cosmetics. Specifically, the device is a stand-alone lip gloss wand with a long flexible stem capable of reaching every spot in a tube of lip gloss and retrieving hard to reach residual lip gloss and a specially designed flame shaped applicator tip for applying both thin and broad strokes of the retrieved lip gloss. Additionally, the device is easily cleaned allowing for use across multiple tubes without cross-contamination.

20 Claims, 8 Drawing Sheets

FIGURE 8A -- Prior Art
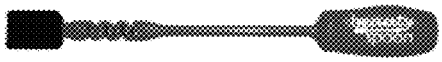
FIGURE 8C -- Prior Art
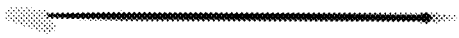
FIGURE 8B -- Prior Art
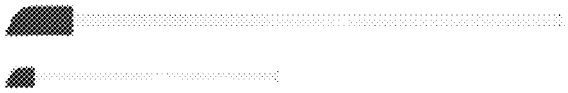
FIGURE 8D -- Prior Art
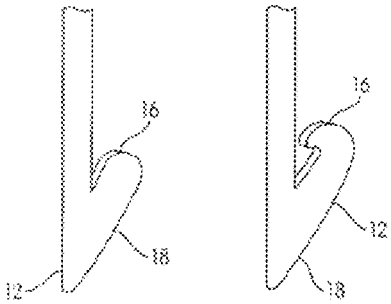

COSMETICS RETRIEVAL AND APPLICATOR TOOL WITH NON-POROUS TIP APPARATUS

PRIOR RELATED APPLICATIONS

This invention claims priority to U.S. 61/712,799, filed on Oct. 11, 2012 and incorporated by reference in its entirety herein.

FEDERALLY SPONSORED RESEARCH STATEMENT

Not applicable.

REFERENCE TO MICROFICHE APPENDIX

Not applicable.

FIELD OF THE DISCLOSURE

The disclosure relates generally to a device for accessing hard-to-reach residual material from containers and applying the residual material to a surface and, specifically, to a device with a flexible applicator for retrieving and applying lip cosmetics.

BACKGROUND OF THE DISCLOSURE

Lip cosmetics have a long and storied history. The earliest documented use of lip cosmetics was by Ancient Mesopotamian women who used crushed gemstones to decorate their lips. Cleopatra was known to combine crushed ants and carmine to color her lips and Queen Elizabeth I's pairing of bright red lips and a very pale face was all the rage in $16^{th}$ century England. Up until the 1880s when the first commercial lipstick was available, women who wanted to color their lips resorted to rubbing them against dyed crepe paper or ribbons, or mixing beeswax with crushed flowers and clays for color and fish scales for shimmer. With the rise of the film industry and the actresses need for dark colors to stand out in black-and-white film, lip cosmetics gained popularity and were soon being purchased by people wishing to emulate film stars. Since then, cosmetics such as lipsticks, lip glosses, and lip stains, in a variety of formats and colors, have become a staple in the modern cosmetic kit.

Lipsticks typically contain wax, oils, emollients, and pigments. More wax is added to have a solidifying affect, rendering the retractable solid pencil/tube shape most people are familiar with. Whereas lipstick offers an intense, solid color, lip gloss has a shiny and slight coloring effect. Though initially created in 1930 to make lips shiny and glossy for films, lip gloss was soon commercialized and now comes in many colors, finishes, and flavors.

Both lipstick and lip glosses now come in a variety of formats beyond the initial solid tube shape. Viscous liquid lip products often come in a small, soft, squeezable plastic tube designed to be passed over the lips. However, less viscous lip products are also available in a small elongated cylindrical containers and can be applied with a fingertip or using a brush or a specially rounded or sloped applicator wand known as a doe foot applicator.

The container/applicator configuration has limitations in that the applicator or brush is coupled with the container and often acts as a lid, thus preventing the use of the applicator with another lip product. Also, conventional applicators often have a brush or sponge-like tip perfect for application of the product. However, these applicators do not reach the bottom of the container and are usually too inflexible to reach lip products located on the sides, especially near the top and bottom of the container. Thus, while useful for their intended purpose, the applicators are not designed to remove residual products. An estimated 20% of the lip product is unreachable by the applicator, resulting in consumers being left with the decision of tossing the container with valuable lip product inside or trying to retrieve the residual product. Retrieval attempts can include cutting the container in half to access the product; removing the stopper of the tube to enable the applicator to reach a deeper depth; and/or using another implement to scrap the bottom but not apply the product. Typically, these efforts far outweigh the little to no residual products that they yield. As a result, consumers frequently waste valuable amounts of lip products.

Many tools are available for accessing the residual material. The Beauty Spoon (www.beautyspoon.com), shown in FIG. 8A is a device with an ergonomic handle, a flexible stem and a flexible contoured spoon for scooping out liquids. The Spatty and the larger Spatty Daddy (www.thespatty.com), displayed in FIG. 8B, are mini spatulas with a flexible stem (6 or 12 inches long) that can be used to remove residual cosmetics or lotions from containers with small openings. The Beauty Spatula (www.everybeautybrand.com), shown in FIG. 8C, is another mini spatula device with a flexible stem, however, the spatula tip has an added edge to aid in retrieving cosmetics. While suitable for retrieving lotions or liquid foundation, the spatulas are not small enough to fit into the openings of lip cosmetic containers. Additionally, while all three devices are capable of retrieving residual products, none are designed for application. Thus, a separate device for applying the retrieved product is necessary which will result in loss of the product while transferring from a tool used to retrieve the product to another tool used to apply the product. Furthermore, these devices do not come with covers or other types of housing thus discouraging their use on the go and away from home.

US20120057922 discloses a cosmetic wand with an upper portion for gripping and an unciform (hook-shaped) tip for removing residual cosmetics along the top, bottom and sides of a container. This wand is a stand-alone product with it own housing for storing, and optionally, allowing for retraction and extension of the wand. The wand is not described as being flexible so it is unclear if it would be capable of accessing the tops, bottoms, and sides of containers of large diameters but small openings, such as those commonly used for lip cosmetics. Additionally, the unciform tip, shown in FIG. 8D, is made out of absorption-type materials such as polyurethane foam, which can increase cross-contamination if used with more than one product. As such, a substantial cleaning process would be necessary if moving between products with different e.g. colors, finishes, or flavors.

Thus, what is needed is a device capable of not only retrieving the residual product from a container, but also applying the product. Ideally, the device is reusable, easy to clean, travel ready, and can be used with multiple products without cross contamination.

SUMMARY OF THE DISCLOSURE

The present disclosure pertains to a device for accessing, retrieving, and applying hard-to-reach residual material from containers. Although this device is described herein for use with cosmetics, particular lip gloss and liquid eye liners, it should be understood that the device can be used in other areas requiring accessing a hard-to-reach liquid or gel-like substance and/or application to a surface. Thus, while the size of the applicator and stem are adjustable, the disclosed preferred embodiments are sized for use with long cylindrical containers with small openings such as those commonly used for packaging lip gloss and liquid eye liners.

In general, this application discloses a part scoop, part applicator device with a grooved handle for gripping, a long flexible stem and a non-porous tip with an applicator specially shaped with a pointed end for applying thin lines or strokes of viscous liquid or gel product and a broader end for applying thicker lines but also useful in scooping. A detachable housing that covers and protects the stem and applicator from contamination can be reversibly connected to the handle of the device. Additionally, a disposable version of said device without the housing is also disclosed.

In one embodiment, the device is a stand-alone cosmetic wand. It has a long flexible stem capable of reaching every spot in a long thin cosmetic container and scooping up hard-to-reach residual product that the applicator that came with the product cannot reach. The stem has a universal length such that is can work with commercially available cosmetic containers from all major and prestigious brands. Additionally, the tip used to scoop up the hard-to-reach product is specially shaped to work as an applicator for the product. The specially designed flame-shaped applicator can apply both thin and broad strokes of the retrieved product. A handle with optional grooves allows for comfortable holding and control of the flexible stem and tip. A detachable housing that snap fits or screws onto the handle protects the stem and tip from contamination, especially when the device is taken on the go. Additionally, the entire device is made from non-porous materials so it can easily be cleaned with soap and water or a moist towelette, thus allowing for use across multiple tubes without cross-contamination.

In a second embodiment is a disposable stand-alone cosmetic wand with a one-piece handle and stem. The stem capable of reaching every spot in a cosmetic container and scooping up hard-to-reach residual product and has a universal length such that is can work with commercially available cosmetic containers from all major or prestigious brands. The handle is formed on one end of the stem and can have grooves, raised bumps, divots, or a rough rubber section for improved grip and control. Additionally, the tip used to scoop up the hard-to-reach product is specially shaped to work as an applicator for the product. The specially designed flame-shaped applicator can apply both thin and broad strokes of the retrieved product. Because the device is made from non-porous materials, it can easily be cleaned with soap and water or a moist towelette, thus allowing for use across multiple tubes without cross-contamination. However, the simpler design is more cost effective such that this embodiment can be disposed after each use.

The above embodiments design for use with cosmetic containers that are long, cylindrical and having small openings. While the disclosure uses lip gloss and eye liner as examples, it should be understood that the above embodiments are capable of retrieving and applying viscous lipsticks, lip stains, lip plumpers, lip conditioners, lip gloss and liquid eye liners.

One benefit of the presently disclosed embodiments over prior retrieval devices is the ability to scoop and apply the retrieved product. This eliminates the need for a separate tool to apply the retrieved product and/or the step of transferring the product from the scoop to an applicator. This is particularly important for lip gloss, which is a sticky, viscous substance that would be especially messy during a transfer step and cause a loss of product during the transfer.

A second benefit of the above embodiments over prior lip product applicators is the ease of cleaning the applicator. Most lip gloss wands, such as that found in US20120057922, have porous applicators such as felt tips or brushes that absorb the gloss and cannot be easily or quickly cleaned. Thus, cross-contamination of products would result if a porous applicator were used among multiple products. This is especially important for lip gloss because lip glosses come in a variety of colors (both heavy and slight), finishes, and flavors and any cross-contamination would render a tube unusable for its original attributes (e.g. mixed flavor or color, metallic flakes in a previously transparent gloss, etc.). The present device is composed of smooth non-porous polymer shapes thus preventing trapping of retrieved product in crevices or under edges.

Another benefit is the small size of the tip. Most commercially available retrieval devices have a spatula that can fit in containers for cosmetic lotions or liquid foundations, but are too big to fit through the small openings used in containers for lip products and liquid eye liners. Thus, the present embodiments can be used with the smallest opening used in cosmetic containers and any larger openings.

A novel aspect and benefit of the presently disclosed device is the shape of the applicator. Most applicators are either brushes or doe foot shaped. These shapes are excellent for broad swiping of the e.g. lip gloss but horrible for fine detail. The present applicator has a solid flame-shape with a pointed end and a broader end closer to the flexible stem. The pointed end is capable of applying fine strokes such as those used for lining or applying the product to the contours of the upper lip. The broader ends are capable of applying much thicker strokes such as those used for a full bottom lip. As such, this present device has full lip and lining applications. No other applicator offers both types of applications. In addition to applying lip gloss, such a shape is also important to the application of other cosmetics such as liquid eye liner. Thus, one device can be used to retrieve and apply a variety of cosmetics with no cross contamination. With the easy to clean feature and special applicator shape, the presently disclosure device can be used to apply multiple cosmetics during one makeup session.

Another benefit is the portability of the present device. All lip glosses come with a shortened applicator that is usually attached to the lid of the container of gloss. Tools for retrieving products, such as the spatulas in FIG. 8A-C, generally do not come with a housing, thus relegated these devices to home use in fear of becoming dirty when taken on the go or transferring sticky lip gloss to other items in a bag or purse. In contrast, the present device is equipped with a detachable housing that can snap fit or screw onto the handle. This allows a user to throw the present device in a pocket, purse, makeup bag, or other bag without worrying about the applicator or stem becoming dirty or being in contact with undesirable objects. Thus, the applicator can be used with one lip gloss product in the morning, then cleaned and stowed in a travel makeup bag to be used with a second product during an evening application of makeup.

The detachable housing can be reversibly attached using any means known in the art including e.g. screw fit, snap fit or magnetic fit. Ideally, the snap fit or screw fit is preferred as being the cheapest to manufacture because the magnetic fit would require incorporating a slim magnetic without any protrusion.

According to an embodiment of the present disclosure, the device comprises 1) a flexible stem having a non-porous flexible calligraphy nib-shaped tip connected at one end and a collar connected at the other end, wherein said collar is bonded to a grooved handle and 2) a detachable housing for covering the stem and tip that reversibly connects to the collar by a snap fit. Alternatively, the housing can be attached to the handle by a screw fit or snap fit.

In a variation to the above embodiment, the device comprises 1) a flexible stem having a splayed end and a non-porous flexible nib-shaped tip connected at the opposite end, 2) a grooved handle bonded to the splayed end of the flexible stem, and 3) a detachable housing for covering the stem and tip that reversibly connects to the handle by a snap fit or screw fit.

In a disposable variation of the above embodiment, the device comprises 1) a one-piece flexible stem and handle, wherein the stem has a rectangular end with optional grips for gripping the device and 2) a non-porous flexible nib-shaped tip connected at the opposite end. No housing is needed with this embodiment.

According to another embodiment of the present disclosure, the device comprises a flexible stem having a removable non-porous flexible nib-shaped tip connected at one end and a collar connected at the other end, wherein the collar that is bonded to a handle and a detachable housing for covering the stem and tip that reversibly connects to the handle or alternatively, connects to the collar, by any means known in the art. Such a device would allow for replacement of the tip without replacing the entire device.

In yet another embodiment, the device comprises 1) a flexible stem having a splayed end and a male connector at the opposite, 2) a non-porous flexible flame-shaped applicator-only tip with a female connector that is sized and shaped to connect to the male connector on the flexible stem, 3) a grooved handle affixed to the splayed end of the flexible stem, and 4) a detachable housing for covering the stem and tip that reversibly connects to the handle by a snap fit or screw fit.

In a variation of the above embodiments, the device is disposable and comprises a one-piece flexible stem and easy to hold handle, wherein the flexible stem has a male connector at the end opposite the handle for attaching an applicator-only tip with a female connector. This disposable version would be ideal for makeup artist who would dispose of the device after each client.

The term "flame-shape" is used herein to describe the shape of the applicator portion of the tip and means an applicator having a generally cone-shape with a point at one end, a diameter that increases until approximately midway down the length of the tip, then decreases slightly to a broad flat edge at the opposite end.

The terms "calligraphy nib" or "nib" are used interchangeably to refer to the shape of the entire tip according to one embodiment, which includes the flame-shaped applicator and a cylindrical base.

The terms and "doe foot" and "brush" are used interchangeably to refer to prior art and commercially available porous lip product applicators. It should be understood that "Doe foot" refers to applicators with a sloped or angular 'hoof' shape and can include spongy or felt tips or flat, angles brushes.

The term "bonded" is used to refer to secure, permanent joining of two or more pieces by e.g. glue, cement, or pressure fit.

The term "screw fit" is used to describe an attachment means wherein one piece has helical or advancing spiral threads and the second piece has helical grooves of the same size and number of the threads, such that the two pieces can be reversibly joined by twisting into place.

The term "snap fit" is used to describe an attachment means wherein one piece has one or more protrusions that fit into one or more indentions on a second piece, such that the protrusions 'snap' into the indentions to join the two pieces.

The phrases "male connector" and "female connector" are common mechanical terms to describe each half of a pair of mating connectors, wherein the 'female' connector has a receptacle that received and holds the 'male' connector. In the present disclosure, it is envisioned that such connectors are affixed by press fit or snap fitting of both ends of the connectors. Bonding means can also be used alongside the press or snap fit.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| ABBREVIATION | TERM |
|---|---|
| ABS | acrylonitrile butadiene styrene |
| mm | millimeters |
| EPDM | ethylene propylene diene monomer rubber |

BRIEF DESCRIPTION OF THE DRAWINGS

FIG. 8 displays the prior art previously developed for attempting to retrieve residual liquids or gels. FIG. 8A is the Beauty Spoon (Alexa Brands, LLC); FIG. 8B is the Spatty (bottom) and Spatty Daddy (top) (The Spatty); FIG. 8C is the Beauty Spatula (Consumer Inspired Products, LLC); and, FIG. 8D is the tip of the device disclosed in US20120057922 (Nikki's Magic Wand).

DETAILED DESCRIPTION

Figure 1:
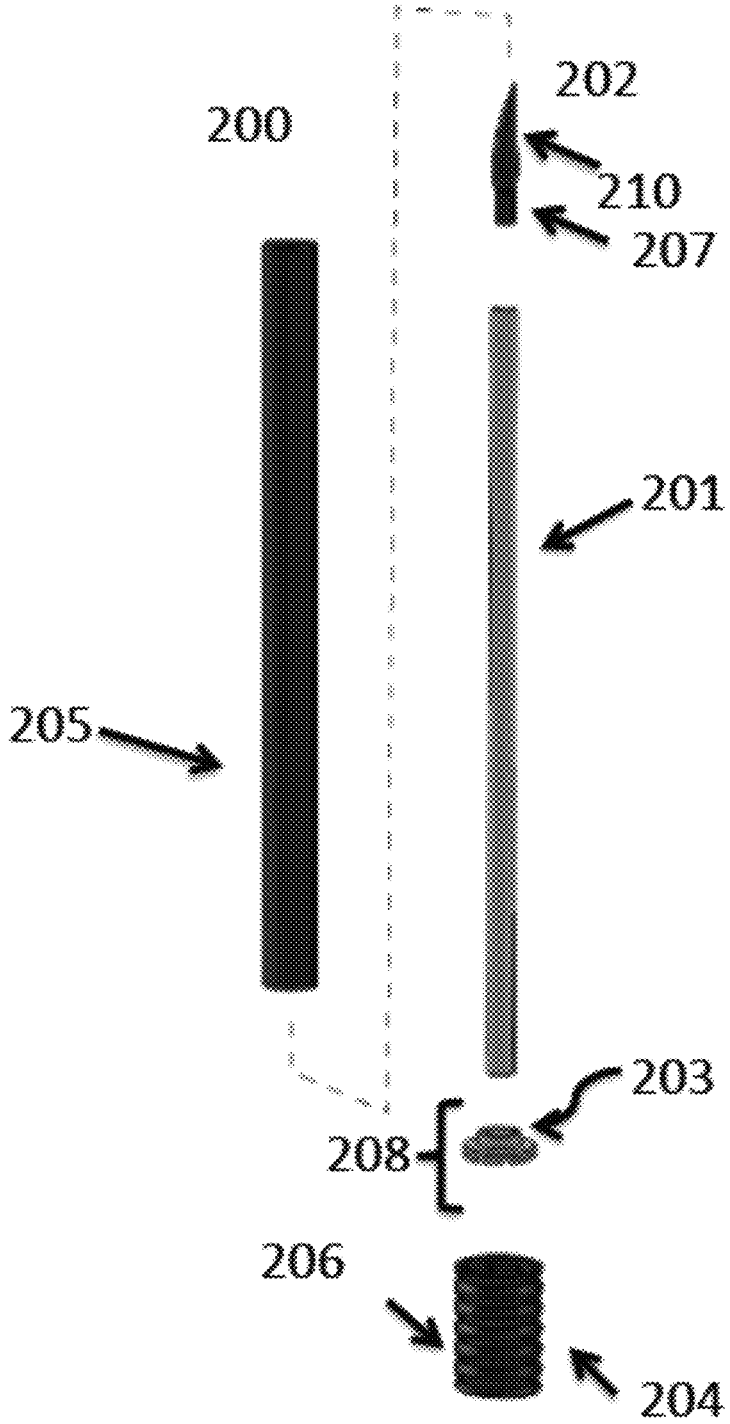
FIG. 1 displays one embodiment of the present disclosure unassembled.

The disclosure provides a novel device for accessing and applying hard-to-reach residual material from a long elongated container with small openings. In particular, the device is a stand-alone applicator for scooping hard-to-reach residual lip gloss, lip cosmetics or even other beauty products such as liquid eye liner from a container and applying the product to the lips, in the case of lip gloss or lip cosmetics, using a specially shaped applicator allowing for thin and broad strokes.

Briefly, the disclosure provides a novel device for retrieving and applying residual materials from a container. This device has a handle adapted for gripping by a user, wherein the handle has a first end that is gripped by the user and, opposite to the first end, a second end of the handle that is a generally planar surface having a neck that defines a neck passage. The first end of the handle can have optional grip enhancers selected from a group comprising grooves, raised bumps, recessed divots, or textured strip to facilitate a better gripping by the user if needed.

A flexible stem extends into the neck passage of the handle and is fixed to the second end of the handle. The opposite end of the flexible stem extends from the handle and has a non-porous flexible tip fixed to the end opposite the handle. This non-porous flexible tip has a flame shape with a pointed end that increases in diameter to a maximum width at approximately the midway length of said non-porous flexible tip and then slightly decreases to said broad flat end, wherein said broad flat end is at least about 75% of said maximum width. The broad flat end is adjacent to and in contact with the second end of the flexible stem. The flexible stem and the non-porous flexible tip can be connected through the use of a male/female connector or by having a base extending from the broad flat end of the tip pressure fit into the open end of the flexible stem.

A detachable housing enclosing the non-porous flexible tip and the flexible stem and contacting said handle is also provided. The detachable housing can have screw threading or protrusions that match optional threading and recessions on the handle, or vice versa, to reversibly attach the housing.

In a variation of the above device, the handle can have a collar fixed to the neck wherein the flexible stem extends through and is fixed to a center opening in the collar. In this design, the detachable housing may be able to snap fit into one or more recessions on the collar.

The handle, flexible stem, tip, detachable housing, and optional collar in the above devices are made of a lightweight thermoplastic elastomer comprising styrene, C2-C5 alkene, acrylate, m-class rubbers, amides and/or acrylonitrile or a combination thereof.

The disclosure also provides for a device for retrieving and applying residual materials from a container that comprises:

1) A handle adapted for gripping by a user, wherein the handle has a first end that is gripped by the user and, opposite to the first end, a second end of the handle that is a generally planar surface having a neck that defines a neck passage. The handle can have grip enhancer selected from a group comprising grooves, raised bumps, recessed divots, or rough strip.

2) A flexible stem that has a splayed end that extends into the neck passage of the handle and is fixed to the second end of the handle and a second end that extends from the handle for approximately 90-100 mm. The second end also has a male connector opposite said handle.

3) A non-porous flexible tip fixed to the end opposite the handle having a female connector that receives the male connector on the flexible stem. This non-porous flexible tip has a pointed end and a broad flat end, wherein the broad flat end has the female connector recession and is adjacent to and in contact with the end of the flexible stem when attached. The pointed end of the tip has a flame shape of approximately 10-20 mm in length.

4) A detachable housing that encloses the non-porous flexible tip and the flexible stem and is in contact with handle. The detachable housing can have screw threading or protrusions that match optional threading and recessions on the handle, or vice versa, to reversibly attach the housing.

The handle, flexible stem and detachable housing are made of polypropylene and the non-porous flexible tip is made of an EPDM/polypropylene polymeric blend.

Additionally, the disclosure provides for a disposable device for retrieving and applying residual materials in a container. The disposable device has a flexible polypropylene stem approximately 105-125 mm in length, where the flexible polypropylene stem has a first and second end. The first end is handle-like and adapted for gripping by a user and approximately 15-25 mm in length and the second end is connected to a non-porous flexible tip. The non-porous flexible tip is composed of a mixture of polypropylene and EPDM blend and is fixed to the second end of the flexible stem by a generally cylindrical base. An applicator that is flame shaped having a pointed end and a broad flat end extends from the base such that the broad flat end is joined to said base and is adjacent to the second end of the flexible stem when the base is press fit into the second end of the flexible stem. The non-porous flexible tip has a length of 15-25 mm, wherein the base is 3.5-6.5 mm in length and the applicator is 10-20 mm in length with a maximum diameter of 4-5 mm.

The present invention is exemplified with respect to FIGS. 1-7. However, these figures are exemplary only, and the invention can be broadly applied to any field where retrieval of a viscous liquid or gel from the top, bottom and sides of a container is necessary. The following examples are intended to be illustrative only, and not unduly limit the scope of the appended claims.

Non-Disposable Embodiments

Figure 3:
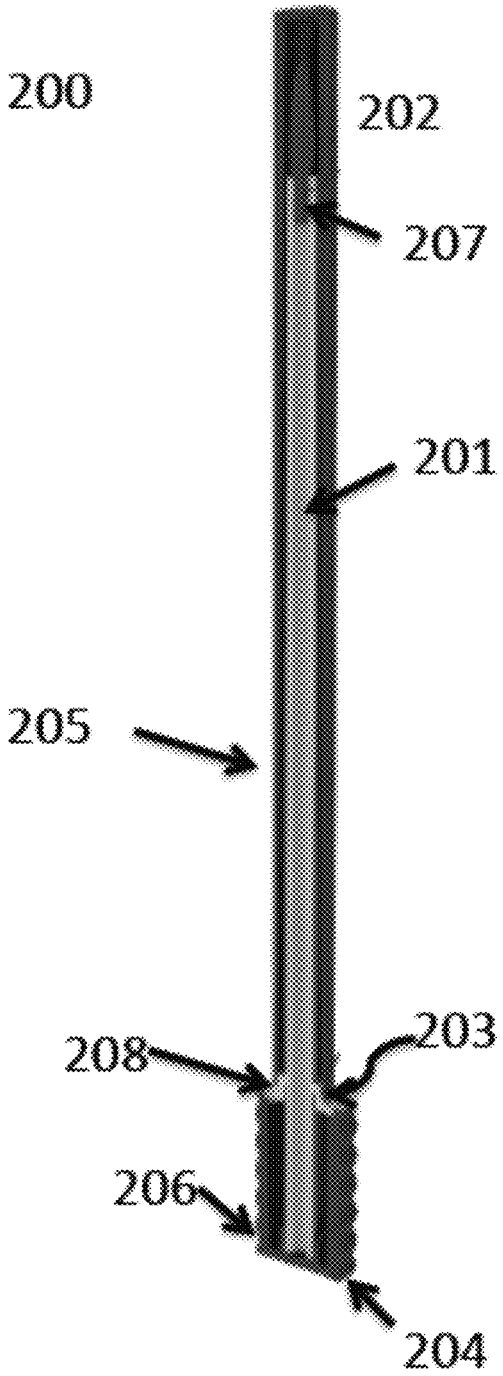
FIG. 3 shows a cross-section of the assembled embodiment in FIG. 2.

FIG. 1 illustrates the presently disclosed device (200) according to one embodiment unassembled. Here, the device (200) has a non-porous flexible nib-shaped tip (202) with a flame-shaped applicator (210) and a base (207) that fits into the flexible stem (201). At the opposite end of the flexible stem (201) is a collar (208) that can be bonded to a handle (204) to secure the stem. The handle (204) can be smooth (See. FIG. 3, 204*b*) or have one or more grooves (206) or other grip enhancements to facilitate gripping and handling. The collar (208) also has a lip (203) for attaching a detachable housing (205) via a snap fit (see FIG. 4A). While not shown, it is possible to attach the housing (205) to the handle (204) using a screw fit. In this case, the collar (208) would be located further into the handle below the thread ridges. As shown by the dotted line, the detachable housing (205) fits over and encloses the tip (202) and flexible stem (201).

Figure 2:
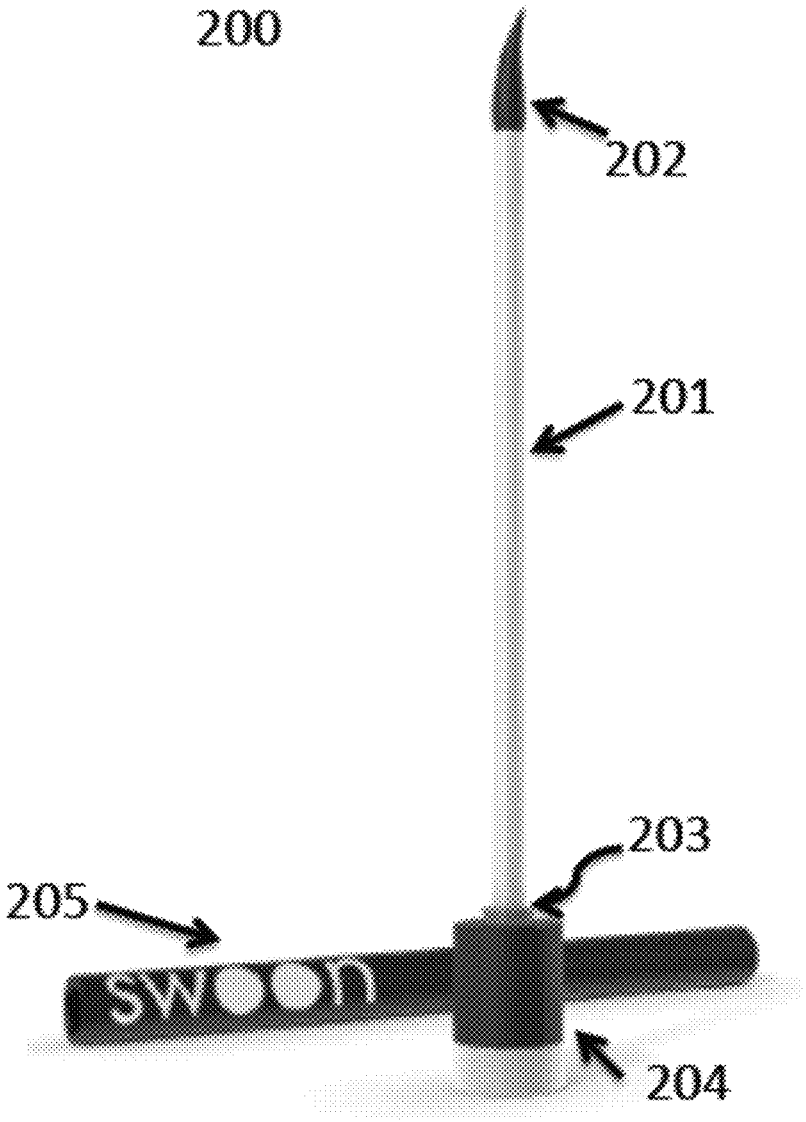
FIG. 2 displays the assembled embodiment displayed in FIG. 1.

FIG. 2 displays the device (200) after it has been assembled and FIG. 3 is a cross-section of the assembled device (200) in FIG. 2. Each element is described below in more detail.

The handle (204) can be generally cylindrical in shape or other configuration with one end being adapted for gripping and the opposite second end having a neck defining a neck passageway. The handle (204) can also be fitted with grip enhancements. FIGS. 1 and 3 display the handle (204) as having one or more grooves, however other grip enhancements such as raised bumps, divots, and textured strips are possible. The handle (204) has a neck passageway, thus allowing the flexible stem (201) and/or collar (208) to extend into the handle.

Figure 4A:
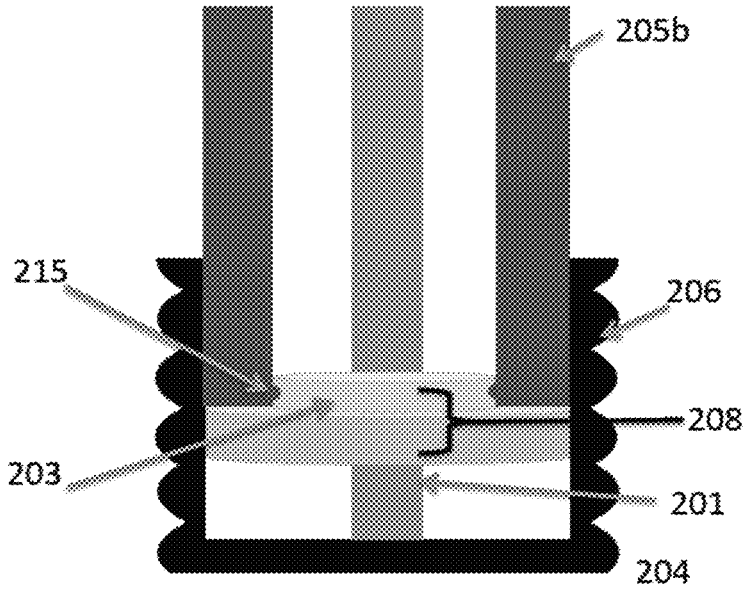
FIGS. 4A-B display alternative positioning of snap fit connectors according to two embodiments, wherein FIG. 4A displays the housing snap fit onto the collar and FIG. 4B displays the housing snap fit onto the handle.
Figure 4B:
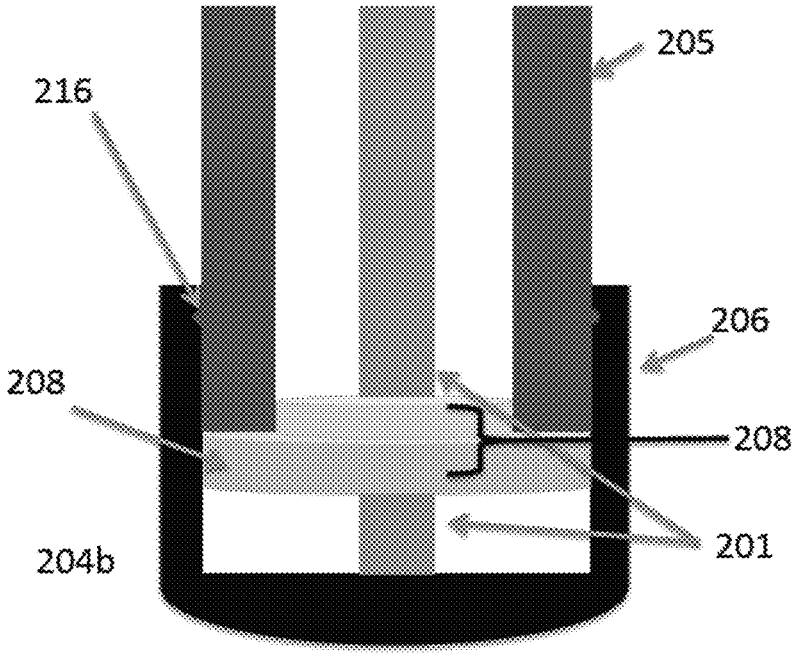
Figure 5:
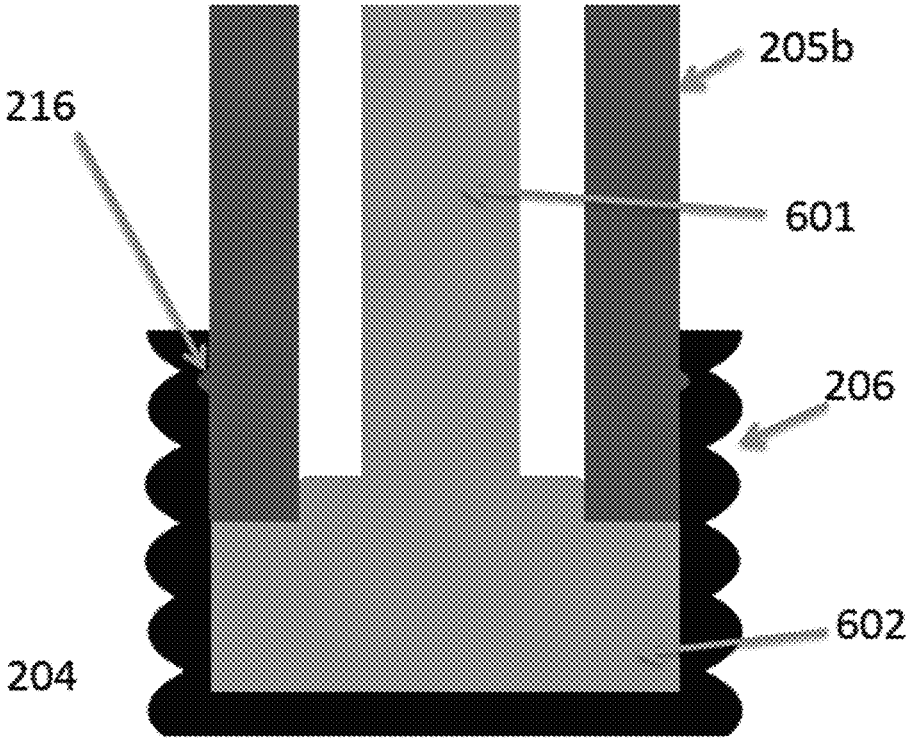
FIG. 5 displays another embodiment of the present disclosure wherein the stem is affixed directly to the handle without a collar.

The neck passageway may include thread ridges or thread grooves screwing on the housing or recesses or protrusions for snap fit attachment of the housing to the handle (204). FIG. 4B and FIG. 5 show the neck passageway with recesses (216) for snapping the housing (205*b*). Other means to fasten the handle to the housing known to those skilled in the art can be used.

As mentioned above, the flexible stem (201) is capable of extending into the handle (and secured to the handle (205)). In the embodiment shown in FIGS. 1-3, a collar (208) is used to hold the stem (201) in place via bonding or pressure fit and prevent it from sliding out. The collar (208) is a disc shaped device, with an outer edge bonded to the handle and an inner edge bonded to the stem. As seen in FIG. 4A, the collar (208) may have a raised lip (203) on the flat circular portion of the disc shape that can snap fit (215) with a detachable housing (205). In FIG. 4A, the collar (208) is shown as being bonded to the handle (204) at approximately the midpoint, however this is exemplary only. The collar (208) can be bonded at any distance along the length inside of the handle (204), including at the opening end of the handle as shown in FIGS. 1-3.

In another embodiment of the present disclosure, the flexible stem and collar are one piece, as illustrated in FIG. 5. In this embodiment, the alternative embodiment of the flexible stem (601) has a splayed end (602) that is fixed into the neck passageway of the handle (204*b*) by either a pressure fit, push fit or bonding. In such a configuration, the attachment recesses (216) for the housing (205*b*) would be located on the handle (204).

The flexible stem (201, 601) extends from the handle (204) for a distance that is commensurate with the length of cosmetic containers. The exposed length of the stem (201, 601), from the edge of the handle to the edge of the applicator (210) of the tip (202), is based on a sampling of lip gloss tubes from prestigious brands. The device was used to reach every spot of these "test" tubes. However, depending on the application and container size, the flexible stem (201, 601) can be lengthened or shortened as desired.

The tip (202) of the device (200) has a soft and flexible scooping applicator (210). The tip (202) itself is similar in shape to a calligraphy nib, but the actual scoop/applicator (210) portion has a flame shape. This particular shape is not seen in other applicators, especially those used with lip gloss, which are usually brushes or doe foot shaped foam. The fine point of the current described applicator (210) is used for lining (applying thin lines of product) or applying lip products to the top lip, whereas the fuller, broad portion of the applicator (210) is ideal for applying thicker lines or applying lip products to the bottom lip.

The tip (202) has a base (207), similar to the nib, extending from the broad end of the applicator (210) and opposite the pointed end. According to one embodiment of the present invention shown in FIGS. 1-3 and 6A, the base of the tip (207) is inserted into the flexible stem (201) to connect the tip (202) to the stem (201).

Figure 6A:
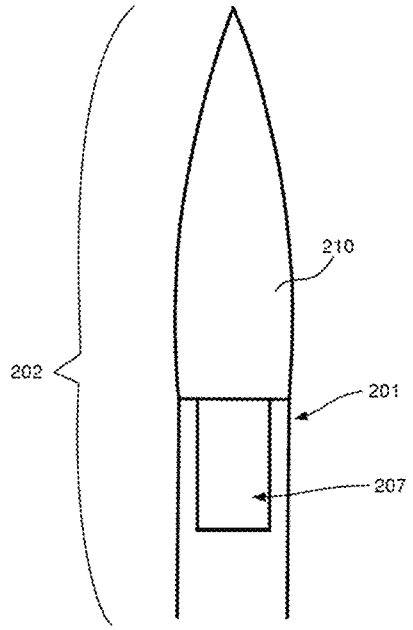
FIG. 6A is a schematic of a nib-shaped tip according to one embodiment of the present invention with preferred dimensions, where the base of the tip slides into the flexible stem for tip attachment.
Figure 6B:
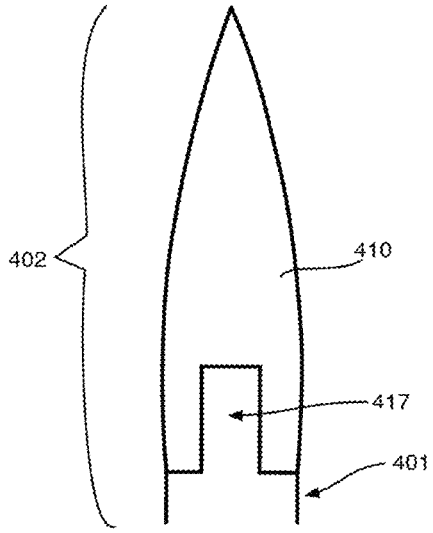
FIG. 6B displays a flame-shaped applicator-only tip according to another embodiment of the present invention, wherein the applicator has a female connector to receive and hold a male connector on the flexible stem for tip attachment.

In another embodiment illustrated in FIG. 6B, the flexible stem (401) can have a male connector (417) that would fit into a corresponding female connector on the tip (402). Such a tip (402) would consist of the flame-shaped applicator (410) but not the base (207) seen in previous embodiments.

Typically, the base (207) or male connector (417) is permanently attached using bonding to prevent the tip (202, 402) from being dislodged. However, in one embodiment of the present invention, the tip (202, 402) can be removed from the stem (201, 401) and replaced as needed. In such instance, the tip (202, 402) will be reversibly attached using e.g. pressure, push or snap fittings with the stem (201, 401). This would facilitate the replacement of the tip (202, 402) without replacing the entire device (200).

The broad end of the applicator (210, 410) is sized to match the outer diameter of the flexible stem (201, 401). This will allow for a smooth connection between the two pieces without crevices, edges or gaps that can trap the retrieved product. This is especially important for preventing cross-contamination.

The device also includes a detachable housing for storing the device. FIGS. 4-5, described above, show the detachable housing (205, 205*b*) snap fit to recesses on the collar (215) or snap fit to recesses on the handle (216). Other attachment methods are possible. For instance, the handle can have a series of thread grooves for screw fitting a housing with complementary threads. Both the housing and the handle could also be fitted with internal magnetics facilitating a magnetic attachment.

The housing is particularly advantageous for carrying the device in a purse or makeup bag because it keeps the applicator clean between uses and protects the device itself. Other tools specifically designed for retrieving gel-like products for containers do not generally come with housing which means they are generally for at-home use or that the consumer must risk the tip coming into contact with dirt or, in the alternative, transferring retrieve product to other items in the carrier.

FIG. 5 as discussed above displays another embodiment of the present disclosure. In this embodiment, a flexible stem (201) with a splayed end (601) is used in place of the stem/collar combination described above. Here, the splayed end (601) is affixed to the inside of the handle (204) by any means known in the art such as bonding, snap fitting, or push fitting. The detachable housing and tip can be attached using any of the previously described methods.

Disposable Embodiments

Figure 7:
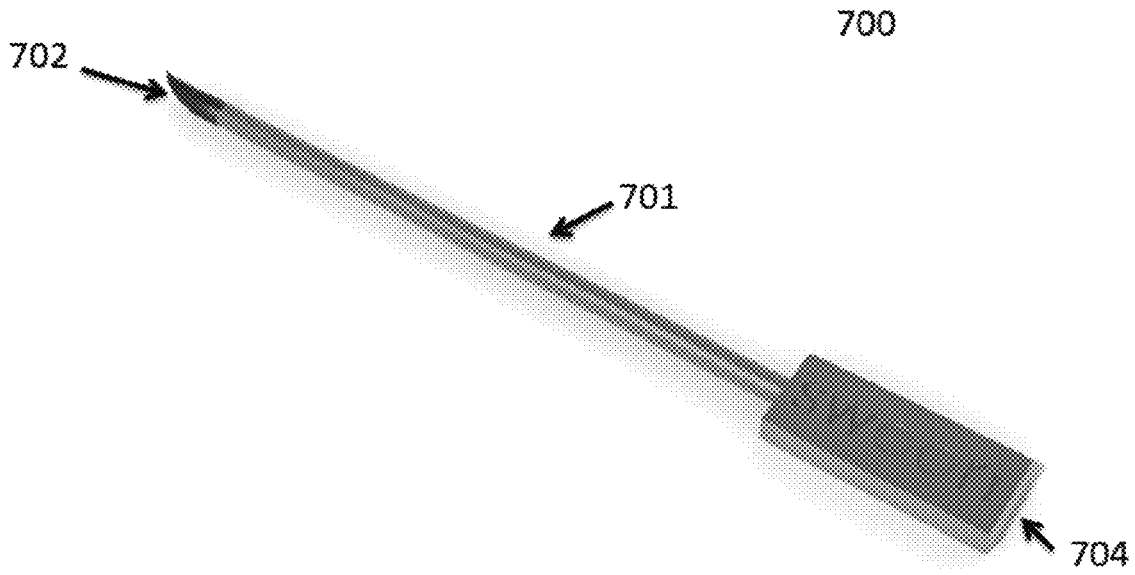
FIG. 7 displays an embodiment of the present disclosure wherein the device is disposable.

FIG. 7 displays a disposable embodiment (700) of the present disclosure. The disposable device (700) would be ideal for makeup artist who apply makeup to multiple clients. Thus, one device can be used per client and discarded.

In this embodiment, the handle (704) and flexible stem (701) are one piece and the tip (702) can be any one of those disclosed above. For instance, the base of the tip (702) can be inserted into the end of the flexible stem (701) opposite the handle (704) or the stem (701) can have a male connector for attaching to a female connector in an applicator-only tip. The handle (704) is shown here as a rectangle but any shape can be used. Furthermore, grip enhancements such as grooves, divots, bumps, or textured rubber can be added to facilitate grip and handling.

Materials

The materials used in the disclosed devices (200, 700) are non-porous to allow for easy cleaning in between use and between multiple products from many different brands. The device and housing can easily be washed with a general purpose soap and water or wiped clean with a moist towelette such as a baby wipe or wet wipe.

The handles, flexible stems, and housings are made out of a lightweight thermoplastic polymer comprising styrenes, C2-C5 alkenes, acrylates, amides urethanes, rubbers, and/or acrylonitrile monomers. Examples include polypropylene, acrylonitrile butadiene styrene (ABS), polyacrylonitrile, polyethylene vinyl acetate, poly(methyl methacrylate), and polyamides including nylons. Preferably, they are composed of a styrene, C2-C5 alkene and/or acrylonitrile monomer containing polymer, and most preferably, polypropylene.

The tip (202, 402, 702) can be made out of any polymers mentioned above, but is preferably composed of a flexible, non-porous polymer, and most preferably thermoplastic elastomers (also known as thermoplastic vulcanizates) such as polyolefins, polyurethanes, and styrenic block copolymers. Thermoplastic elastomers are often blended with m-class rubbers, which impart water resistance. This added feature is advantageous for the non-porous needs of the tip. Exemplary thermoplastic elastomers or blends include polyethylene, Santoprene™ (Exxon Mobile), OnFlex™-V (PolyOne) and Viprene® (Alliance Polymers & Services). Santoprene™, which is an ethylene propylene diene monomer m-class rubber (EPDM) and polyethylene blend, is the preferably material for the tip. Particularly, Santoprene™ 8221-70 is used because it is a soft, colorable blend with good physical properties and chemical resistance. Although, other Santoprene™ blends with similar specific gravities (~0.95 g/cm$^3$), shore hardness (Shore A, 75), and chemical resistances can also be used.

Any color or finish can be used with each elements of the device. A black, dark grey and/or white satin finish is preferable, but brighter, shinier finishes can also be used, especially when marketing to a younger user.

Measurements

As mentioned above, the length of the flexible stem (201, 601) corresponds to the size of the elongated containers used in cosmetics. Approximate measurements for the exposed portion of the flexible stem (201, 601) include length that is about 90-100 mm, preferably 93-97 mm and most preferably 95.65 mm and an outer diameter of approximately 3-6 mm, preferably 4-5 mm, and most preferably 4.20 mm. By exposed, what is meant is the portion of the flexible stem (201, 601) extending from the top of open end of the handle (204) to the bottom of the applicator (210), as opposed to simply measuring the visible length of the stem. This method of measurements negates varying amounts of visible stem resulting from the placement of the collar (208) within the handle.

Approximate measurements for the handle (204, 204*b*, 704) include a length of 15-25 mm, preferably 18-22 mm and most preferably 20 mm and a width of 12-18 mm, preferably 14-16 mm, and most preferably 15.3-15.7 mm. Many of the embodiments display the handle as being cylindrical (204, 204*b*) or rectangular (704), however any shape can be used. The dimensions of the neck passage in the handle are a width of approximately 8-16 mm, preferably 9-11 mm, and most preferably 10.50 mm.

In some embodiments, the handle and flexible stem are one piece. The measurements are approximately the same for both sections. The flexible stem from said splayed edge to said tip has a length of 90 to 105 mm. However, the exposed stem length remains the same as the previous embodiment: 90-100 mm, preferably 93-97 mm and most preferably 95.65 mm from top of handle to bottom of tip.

The collar (208) according to some embodiments has an outer diameter or width sized to fit snuggly inside the neck passage and is typically 0.02-0.05 mm smaller. Thus, the collar's outer diameter is approximately 7.95-15.98 mm, preferably 8.95-10.98 mm, and most preferably 10.48 mm. The inner diameter of the collar and the raise lip (203) is sized to snuggly fit the flexible stem (201) and is 3-6 mm, preferably 4-5 mm, and most preferably 4.22 mm. The length of the collar (208) and raised lip (203) is approximately 2-7 mm, preferably 3-6, and most preferably 4 mm. The outer diameter of the raise lip (203) is 8-13 mm, preferably 9-11 mm, and most preferably 9.40 mm.

Approximate measurements for the tip (202, 402, 702) include a length of 15-25 mm, preferably a length of 18-22 mm, and most preferably a length of 20 mm. Of that length, the base (207) can be 3.5-6.5 mm, preferably 4.5-6 mm, and most preferably 5 mm. The outer diameter of the base (207) is approximately 65 percent of the outer diameter of the stem. If the preferred stem (201, 701) diameter is 4.2 mm, then the base (207) diameter is 2.75 mm. The applicator makes up the remaining length and is approximately 10-20 mm, preferably 12-19 mm, and most preferably 15 mm.

As mentioned above, the applicator (210, 410) has a flame shape. The applicator (210) of the tip (202) begins with an outer diameter that matches the stem's (201, 401, 701) diameter such that a crevice or lip for residual product to become trapped does not exist. The applicator (210, 410) then widens to a maximum diameter at approximately midway or 45-55 percent of the length of the applicator (210, 410) portion of the tip (202, 402, 702) before narrowing to the pointed tip. The maximum diameter of the applicator is approximately 4-5 mm, and most preferably 4.5 mm. The outer diameter of the base (207) is approximately 60% of the maximum diameter of the applicator or preferably 2.75 mm.

According to one embodiment of the present device, the length of the housing (205, 205*b*) is 115-125 mm, preferably 120-124 mm, and most preferably 121.15-122.05 mm and the outer diameter is 8-13 mm, preferably 9-11 mm, and most preferably 9.44 mm. The inner diameter can be changed to fit a slimmer or wider applicator, but is typically 4-7 mm, preferably 5-7 mm, and most preferably 6.64 mm.

When fully assemble, the device in FIG. 3 should be 130-155 mm in length and, most preferably, approximately 133 mm and have a diameter of 12-18 mm and, most preferably, approximately 15.5 mm at its widest point.

EXAMPLE OF USE

All of the above embodiments can be used for the application of cosmetics, particularly lip gloss or liquid eye liners because these cosmetics are in longer tubes with small openings. As an example of the use of the above devices, a person would grip the handle and dip the applicator into the cosmetic container. The flexible stem would allow for swiping the applicator along the top, bottom and sides of the container to load product on the applicator. Then, the person would remove the device from the container and apply the cosmetic onto the desired location, e.g. lips if applying lip gloss or eyes if applying eyeliner. After a sufficient amount of product is applied, the user can clean the applicator and stem to remove residual product or scrape product off of the applicator into the container, then clean the device. Once clean, the housing can be attached to the device before being stored in a drawer, bag, purse, pocket, vehicle, and the like, until needed.

While the invention is described above in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The following references are incorporated by reference in their entirety.

US20120057922

What is claimed is:

1. A device for retrieving and applying residual materials from a container consisting of:

a) a handle adapted for gripping by a user, said handle having a first end that is gripped by the user and, opposite to the first end, a second end of the handle that is a generally planar surface, said second end having a neck, said neck defining a neck passage;

b) a flexible stem fixed to said second end of said handle and extending from said second end of said handle, said flexible stem having a first and a second end, wherein said first end extends into said neck passage of said handle and said second end extends from said handle;

c) a non-porous flexible tip fixed to the end of said flexible stem opposite said handle, said non-porous flexible tip having a flame shape with a pointed end and a broad flat end, wherein said broad flat end is adjacent to and in contact with said second end of said flexible stem; and, d) a detachable housing enclosing the non-porous flexible tip and the flexible stem and contacting said handle.

2. The device in claim 1, wherein said first end of said handle further comprises a grip enhancer selected from a group comprising grooves, raised bumps, recessed divots, or textured strip.

3. The device in claim 1, wherein said flexible stem further comprises a male connector on said second end and said non-porous flexible tip further comprises a female connector attached to and extending into said broad flat end, such that said female connector receives said male connector to fix said flexible stem to said non-porous flexible tip.

4. The device in claim 1, wherein said second end of said flexible stem further comprises an opening and said non-porous flexible tip further comprises a base attached to and extend from said broad flat end and opposite of said pointed end, such that said opening receives said base to fix said flexible stem to said non-porous flexible tip.

5. The device in claim 1, wherein said detachable housing has helical grooves shaped to screw fit into helical threads on said neck passage of the second end of said handle.

6. The device in claim 1, wherein said detachable housing has one or more protrusions shaped to snap fit into one or more recessions on said neck passage of the second end of said handle.

7. The device in claim 1, wherein said non-porous flexible tip is shaped like a flame such that said pointed end increases in diameter to a maximum width at approximately the midway length of said non-porous flexible tip and then slightly decreases to said broad flat end, wherein said broad flat end is at least about 75% of said maximum width.

8. The device in claim 1, wherein said handle further comprising a collar adapted therein, said collar being fixed to said neck of said handle, said collar having a middle opening wherein said flexible stem extends through and is fixed.

9. The device in claim 8, wherein said detachable housing has one or more protrusions shaped to snap fit into one or more recessions on said collar.

10. The device in claim 1, wherein said handle is made of a lightweight thermoplastic elastomer comprising styrene, C2-C5 alkene, acrylate, m-class rubbers, amides and/or acrylonitrile or a combination thereof.

11. The device in claim 1, wherein said flexible stem is made of a lightweight thermoplastic elastomer comprising styrene, C2-C5 alkene, acrylate, m-class rubbers, amides and/or acrylonitrile or a combination thereof.

12. The device in claim 1, wherein said tip is made of a lightweight thermoplastic elastomer comprising styrene, C2-C5 alkene, acrylate, m-class rubbers, amides and/or acrylonitrile or a combination thereof.

13. The device in claim 1, wherein said detachable housing is made of a lightweight thermoplastic elastomer comprising styrene, C2-C5 alkene, acrylate, m-class rubbers, amides and/or acrylonitrile or a combination thereof.

14. A device for retrieving and applying residual materials from a container consisting of:

a) a handle adapted for gripping by a user, said handle having a first end that is gripped by a user and a second end having a neck opposite said first end, said neck defining a neck passage;

b) a flexible stem fixed to said second end of said handle, said flexible stem extending from said second end of said handle, said flexible stem having a first and a second end, wherein said first end is splayed and extends therewithin said neck into said neck passage and is pressed fit into said handle, wherein said second end extends from said handle for approximately 90-100mm, said second end having a male connector opposite said handle;

c) a non-porous flexible tip fixed to said second end of said flexible stem, said non-porous flexible tip having a pointed end and a broad flat end, said pointed end having a flame shape of approximately 10-20 mm in length, wherein said broad flat end has a female connector attached to and extending therewithin, wherein said female connector receives said male connector on said stem and fixes said non-porous flexible tip to said stem such that said broad flat end is adjacent to and in contact with said second end of said flexible stem; and, d) a detachable housing enclosing the non-porous flexible tip and the flexible stem and contacting said handle.

15. The device in claim 14, wherein said first end of said handle further comprises a grip enhancer selected from a group comprising grooves, raised bumps, recessed divots, or rough strip.

16. The device in claim 14, wherein said detachable housing has helical grooves shaped to screw fit into helical threads on said neck passage.

17. The device in claim 14, wherein said detachable housing has one or more protrusions shaped to snap fit into one or more recessions on said neck passage.

18. The device in claim 14, wherein said handle, said flexible stem and said detachable housing are made of polypropylene.

19. The device in claim 14, wherein said non-porous flexible tip is made of an EPDM/polypropylene polymeric blend.

20. A disposable device for retrieving and applying residual materials in a container consisting of:

a) a flexible polypropylene stem approximately 105-125 mm in length, said flexible polypropylene stem having a first and second end, wherein said first end is handle-like and adapted for gripping by a user and approximately 15-25 mm in length, b) a non-porous flexible tip composed of a mixture of polypropylene and EPDM blend fixed to said second end of said flexible stem by a generally cylindrical base, and c) an applicator extending from the base that is flame shaped having a pointed end and a broad flat end, wherein said broad flat end is joined to said base, wherein said base is press fit into said second end of said flexible stem such that said broad flat end of said applicator is adjacent to said second end of said flexible stem, wherein said non-porous flexible tip has a length of 15-25 mm, wherein said base is 3.5-6.5 mm in length and said applicator is 10-20 mm in length with a maximum diameter of 4-5 mm.

* * * * *